US005418045A

United States Patent [19]

Pike et al.

[11] Patent Number: 5,418,045

[45] Date of Patent: May 23, 1995

[54] NONWOVEN MULTICOMPONENT POLYMERIC FABRIC

[75] Inventors: Richard D. Pike, Norcross; Kurtis L. Brown; Sharon W. Gwaltney, both of Woodstock, all of Ga.; Thomas A. Hershberger, Appleton, Wis.; Scott D. Siegel, Thomasville, N.C.

[73] Assignee: Kimberly-Clark Corporation, Neenah, Wis.

[21] Appl. No.: 310,559

[22] Filed: Sep. 22, 1994

Related U.S. Application Data

[62] Division of Ser. No. 933,444, Aug. 21, 1992, Pat. No. 5,382,400.

[51] Int. Cl.[6] ..... B32B 27/14

[52] U.S. Cl. ..... 428/198; 428/224; 428/284; 428/286; 428/288; 428/296; 428/373; 428/374; 428/913

[58] Field of Search ..... 428/198, 224, 284, 286, 428/288, 296, 373, 374, 913

[56] References Cited

U.S. PATENT DOCUMENTS

| | | | |
|---|---|---|---|
| Re. 30,955 | 5/1979 | Stanistreet | 156/308.2 |
| Re. 31,825 | 2/1985 | Mason et al. | 428/198 |
| 2,931,091 | 4/1960 | Breen | 28/82 |
| 2,987,797 | 6/1961 | Breen | 28/82 |
| 3,038,235 | 6/1962 | Zimmerman | 28/82 |
| 3,038,236 | 6/1962 | Breen | 28/82 |
| 3,038,237 | 6/1962 | Taylor, Jr. | 28/82 |
| 3,377,232 | 4/1968 | Meacock et al. | 161/155 |
| 3,423,266 | 1/1969 | Davies et al. | 156/167 |
| 3,551,271 | 12/1970 | Thomas et al. | 161/150 |
| 3,589,956 | 6/1971 | Kranz et al. | 156/62.4 |
| 3,595,731 | 7/1971 | Davies et al. | 161/150 |
| 3,616,160 | 10/1971 | Wincklhofer | 161/150 |
| 3,692,618 | 9/1972 | Dorschner et al. | 161/72 |
| 3,725,192 | 4/1973 | Ando et al. | 161/175 |
| 3,760,046 | 9/1973 | Schwartz et al. | 264/47 |
| 3,802,817 | 4/1974 | Matsuki et al. | 425/66 |
| 3,824,146 | 7/1974 | Ellis | 161/150 |

(List continued on next page.)

FOREIGN PATENT DOCUMENTS

| | | |
|---|---|---|
| 612156 | 1/1961 | Canada . |
| 618040 | 4/1961 | Canada . |
| 829845 | 12/1964 | Canada . |
| 769644 | 10/1967 | Canada . |
| 792651 | 8/1968 | Canada . |

(List continued on next page.)

OTHER PUBLICATIONS

"Thermobonding Fibers For Nonwovens"—By S. Tomioka—Nonwovens Industry, MAy 1981, pp. 23–24, 30–31.

(List continued on next page.)

*Primary Examiner*—James J. Bell

*Attorney, Agent, or Firm*—Michael U. Lee

[57] ABSTRACT

A process for making nonwoven fabric including the steps of meltspinning continuous multicomponent polymeric filaments, drawing the multicomponent filaments, at least partially quenching the multicomponent filaments so that the multicomponents have latent helical crimp, activating the latent helical crimp, and thereafter, forming the crimped continuous multicomponent filaments into a first nonwoven fabric web. By crimping the filaments before the web formation, shrinkage of the web after formation is substantially reduced and the resulting fabric is substantially stable and uniform. In addition, the resulting fabric can have a relatively high loft. The crimp activating step can include heating the multicomponent filaments and preferably includes drawing the multicomponent filaments with a flow of heated air to activate the latent helical crimp. The resulting fabric can form relatively high loft materials useful as a fluid management layer for personal care absorbent articles or can form cloth-like fabric useful as cover materials and garment material. In addition, a nonwoven fabric comprising continuous single and multicomponent filaments and proces for making same are provided. Still further, a multilayer nonwoven fabric with continuous multicomponent filaments and process for making same are provided. The degree of crimp in the filaments can be varied from layer to layer to produce composite webs with particular fluid handling properties.

50 Claims, 4 Drawing Sheets

U.S. PATENT DOCUMENTS

| | | | |
|---|---|---|---|
| 3,855,045 | 12/1974 | Brock | 161/146 |
| 3,895,151 | 7/1975 | Matthews et al. | 428/102 |
| 3,900,678 | 8/1975 | Aishima et al. | 428/374 |
| 3,940,302 | 2/1976 | Matthews et al. | 156/167 |
| 3,992,499 | 11/1976 | Lee | 264/78 |
| 4,005,169 | 1/1977 | Cumbers | 264/103 |
| 4,068,036 | 1/1978 | Stanistreet | 428/296 |
| 4,076,698 | 2/1978 | Anderson et al. | 526/348.6 |
| 4,086,112 | 4/1978 | Porter | 156/73.1 |
| 4,088,726 | 5/1978 | Cumbers | 264/123 |
| 4,119,447 | 10/1978 | Ellis et al. | 156/73.1 |
| 4,154,357 | 5/1979 | Sheard et al. | 220/88 A |
| 4,170,680 | 10/1979 | Cumbers | 428/195 |
| 4,181,762 | 1/1980 | Benedyk | 428/97 |
| 4,188,436 | 2/1980 | Ellis et al. | 428/198 |
| 4,189,338 | 2/1980 | Ejima et al. | 156/167 |
| 4,195,112 | 3/1980 | Sheard et al. | 428/288 |
| 4,211,816 | 7/1980 | Booker et al. | 428/296 |
| 4,211,819 | 7/1980 | Kunimune et al. | 428/374 |
| 4,216,772 | 8/1980 | Tsuchiya et al. | 128/284 |
| 4,234,655 | 11/1980 | Kunimune et al. | 428/374 |
| 4,258,097 | 3/1981 | Benedyk | 428/224 |
| 4,269,888 | 5/1981 | Ejima et al. | 428/296 |
| 4,285,748 | 8/1981 | Booker et al. | 156/167 |
| 4,306,929 | 12/1981 | Menikheim et al. | 156/290 |
| 4,315,881 | 2/1982 | Nakajima et al. | 264/171 |
| 4,323,626 | 4/1982 | Kunimune et al. | 428/274 |
| 4,340,563 | 7/1982 | Appel et al. | 264/518 |
| 4,356,200 | 10/1982 | Benedyk | 428/17 |
| 4,362,777 | 12/1982 | Miller | 428/224 |
| 4,369,156 | 1/1983 | Mathes et al. | 264/147 |
| 4,373,000 | 2/1983 | Knoke et al. | 428/198 |
| 4,381,326 | 4/1983 | Kelly | 428/134 |
| 4,396,452 | 8/1983 | Menikheim et al. | 156/290 |
| 4,419,160 | 12/1983 | Wang et al. | 156/73.2 |
| 4,434,204 | 2/1984 | Hartman et al. | 428/198 |
| 4,451,520 | 5/1984 | Tecl et al. | 428/198 |
| 4,469,540 | 9/1984 | Furukawa et al. | 156/62.4 |
| 4,477,516 | 10/1984 | Sugihara et al. | 428/296 |
| 4,480,000 | 10/1984 | Watanabe et al. | 428/284 |
| 4,483,897 | 11/1984 | Fujimura et al. | 428/288 |
| 4,485,141 | 11/1984 | Fujimura et al. | 428/288 |
| 4,496,508 | 1/1985 | Hartmann et al. | 264/167 |
| 4,500,384 | 2/1985 | Tomioka et al. | 156/290 |
| 4,504,539 | 3/1985 | Petracek et al. | 428/195 |
| 4,511,615 | 4/1985 | Ohta | 428/198 |
| 4,520,066 | 5/1965 | Athey | 428/288 |
| 4,530,353 | 7/1985 | Lauritzen | 128/156 |
| 4,546,040 | 10/1985 | Knotek et al. | 428/370 |
| 4,547,420 | 10/1985 | Krueger et al. | 428/229 |
| 4,551,378 | 11/1985 | Carey, Jr. | 428/198 |
| 4,552,603 | 11/1985 | Harris, Jr. et al. | 156/167 |
| 4,555,430 | 11/1985 | Mays | 428/134 |

(List continued on next page.)

FOREIGN PATENT DOCUMENTS

| | | |
|---|---|---|
| 846761 | 7/1970 | Canada . |
| 847771 | 7/1970 | Canada . |
| 852100 | 9/1970 | Canada . |
| 854076 | 10/1970 | Canada . |
| 896214 | 3/1972 | Canada . |
| 903582 | 6/1972 | Canada . |
| 959221 | 12/1974 | Canada . |
| 959225 | 12/1974 | Canada . |
| 989720 | 5/1976 | Canada . |
| 1051161 | 3/1979 | Canada . |
| 1058818 | 7/1979 | Canada . |
| 1060173 | 8/1979 | Canada . |
| 1071943 | 2/1980 | Canada . |
| 1081905 | 7/1980 | Canada . |
| 1103869 | 6/1981 | Canada . |
| 1109202 | 9/1981 | Canada . |
| 1128411 | 7/1982 | Canada . |
| 1133771 | 10/1982 | Canada . |
| 1140406 | 2/1983 | Canada . |
| 1143930 | 4/1983 | Canada . |
| 1145213 | 4/1983 | Canada . |
| 1145515 | 5/1983 | Canada . |
| 1148302 | 6/1983 | Canada . |
| 1172814 | 8/1984 | Canada . |
| 1174039 | 9/1984 | Canada . |
| 1175219 | 10/1984 | Canada . |
| 1178524 | 11/1984 | Canada . |
| 1182692 | 2/1985 | Canada . |
| 1204641 | 5/1986 | Canada . |
| 1208098 | 7/1986 | Canada . |
| 1218225 | 2/1987 | Canada . |
| 1226486 | 9/1987 | Canada . |
| 1230720 | 12/1987 | Canada . |
| 1230810 | 12/1987 | Canada . |
| 1234535 | 3/1988 | Canada . |
| 1235292 | 4/1988 | Canada . |
| 1237884 | 6/1988 | Canada . |
| 1250412 | 2/1989 | Canada . |
| 1257768 | 7/1989 | Canada . |
| 1259175 | 9/1989 | Canada . |
| 1267273 | 4/1990 | Canada . |
| 2001091 | 4/1990 | Canada . |
| 1272945 | 8/1990 | Canada . |
| 1273188 | 8/1990 | Canada . |

U.S. PATENT DOCUMENTS

| | | | |
|---|---|---|---|
| 4,555,811 | 12/1985 | Shimalla | 2/51 |
| 4,557,972 | 12/1985 | Okamoto et al. | 428/373 |
| 4,588,630 | 5/1986 | Shimalla | 428/131 |
| 4,595,629 | 6/1986 | Mays | 428/286 |
| 4,632,858 | 12/1986 | Knoke et al. | 428/287 |
| 4,644,045 | 2/1987 | Fowells | 526/348 |
| 4,656,075 | 4/1987 | Mudge | 428/110 |
| 4,657,804 | 4/1987 | Mays et al. | 428/212 |
| 4,663,220 | 5/1987 | Wisneski et al. | 428/221 |
| 4,681,801 | 7/1987 | Eian et al. | 428/283 |
| 4,684,570 | 8/1987 | Malaney | 428/296 |
| 4,713,134 | 12/1987 | Mays et al. | 156/181 |
| 4,713,291 | 12/1987 | Sasaki et al. | 428/373 |
| 4,722,857 | 2/1988 | Tomioka et al. | 428/113 |
| 4,731,277 | 3/1988 | Groitzsch et al. | 428/137 |
| 4,737,404 | 4/1988 | Jackson | 428/284 |
| 4,749,423 | 6/1988 | Vaalburg et al. | 156/181 |
| 4,755,179 | 7/1988 | Shiba et al. | 604/370 |
| 4,756,786 | 7/1988 | Malaney | 156/308.2 |
| 4,770,925 | 9/1988 | Uchikawa et al. | 428/219 |
| 4,774,124 | 9/1988 | Shimalla et al. | 428/171 |
| 4,774,277 | 9/1988 | Janac et al. | 524/474 |
| 4,787,947 | 11/1988 | Mays | 156/160 |
| 4,789,699 | 12/1988 | Kieffer et al. | 524/271 |
| 4,795,559 | 1/1989 | Shinjou et al. | 210/490 |
| 4,795,668 | 1/1989 | Krueger et al. | 428/174 |
| 4,804,577 | 2/1989 | Hazelton et al. | 428/224 |
| 4,808,202 | 2/1989 | Nishikawa et al. | 55/390 |
| 4,814,032 | 3/1989 | Taniguchi et al. | 156/167 |
| 4,818,587 | 4/1989 | Ejima et al. | 428/198 |
| 4,830,904 | 5/1989 | Gessner et al. | 428/219 |
| 4,839,228 | 6/1989 | Jezic et al. | 428/401 |
| 4,840,846 | 6/1989 | Ejima et al. | 428/373 |
| 4,840,847 | 6/1989 | Ohmae et al. | 428/373 |
| 4,851,284 | 7/1989 | Yamanoi et al. | 428/284 |
| 4,872,870 | 10/1989 | Jackson | 604/366 |
| 4,874,447 | 10/1989 | Hazelton et al. | 156/167 |
| 4,874,666 | 10/1989 | Kubo et al. | 428/398 |
| 4,880,691 | 11/1989 | Sawyer et al. | 428/225 |
| 4,883,707 | 11/1989 | Newkirk | 428/219 |
| 4,909,975 | 3/1990 | Sawyer et al. | 264/210.7 |
| 4,966,808 | 10/1990 | Kawano | 428/224 |
| 4,981,749 | 1/1991 | Kubo et al. | 428/219 |
| 4,997,611 | 3/1991 | Hartmann | 264/210.8 |
| 5,001,813 | 3/1991 | Rodini | 19/0.46 |
| 5,002,815 | 3/1991 | Yamanaka et al. | 428/109 |
| 5,058,141 | 11/1991 | Kubo et al. | 428/219 |
| 5,069,970 | 12/1991 | Largman et al. | 428/373 |
| 5,082,720 | 1/1992 | Hayes | 428/224 |
| 5,108,276 | 4/1992 | Hartmann | 425/66 |
| 5,108,820 | 4/1992 | Kaneko et al. | 428/198 |
| 5,108,827 | 4/1992 | Gessner | 428/219 |
| 5,125,818 | 6/1992 | Yeh | 425/131.5 |
| 5,126,201 | 6/1992 | Shiba et al. | 428/389 |
| 5,244,723 | 9/1993 | Anderson et al. | 428/283 |

NONWOVEN MULTICOMPONENT POLYMERIC FABRIC

This application is a divisional of application Ser. No. 07/933,444 entitled "Nonwoven Multicomponent Polymeric Fabric and Method of Making Same" and filed in the U.S. Patent and Trademark Office on Aug. 21, 1992 now U.S. Pat. No. 5,382,400.

TECHNICAL INFORMATION

This invention generally relates to polymeric fabrics, and more particularly relates to multicomponent nonwoven polymeric fabrics made with continuous helically crimped filaments.

BACKGROUND OF THE INVENTION

Nonwoven fabrics are used to make a variety of products, which desirably have particular levels of softness, strength, uniformity, liquid handling properties such as absorbency, and other physical properties. Such products include towels, industrial wipes, incontinence products, infant care products such as baby diapers, absorbent feminine care products, and garments such as medical apparel. These products are often made with multiple layers of nonwoven fabric to obtain the desired combination of properties. For example, disposable baby diapers made from polymeric nonwoven fabrics may include a liner layer which fits next to the baby's skin and is soft, strong and porous, an impervious outer cover layer which is strong and soft, and one or more interior liquid handling layers which are soft, bulky and absorbent.

Nonwoven fabrics such as the foregoing are commonly made by melt spinning thermoplastic materials. Such fabrics are called spunbond materials and methods for making spunbond polymeric materials are wellknown. U.S. Pat. No. 4,692,618 to Dorschner et al. and U.S. Pat. No. 4,340,563 to Appel et al. both disclose methods for making spunbond nonwoven polymeric webs from thermoplastic materials by extruding the thermoplastic material through a spinneret and drawing the extruded material into filaments with a stream of high velocity air to form a random web on a collecting surface. For example, U.S. Pat. No. 3,692,618 to Dorschner et al. discloses a process wherein bundles of polymeric filaments are drawn with a plurality of eductive guns by very high speed air. U.S. Pat. No. 4,340,563 to Appel et al. discloses a process wherein thermoplastic filaments are drawn through a single wide nozzle by a stream of high velocity air. The following patents also disclose typical melt spinning processes: U.S. Pat. No. 3,338,992 to Kinney; U.S. Pat. No. 3,341,394 to Kinney; U.S. Pat. No. 3,502,538 to Levy; U.S. Pat. No. 3,502,763 to Hartmann; U.S. Pat. No. 3,909,009 to Hartmann; U.S. Pat. No 3,542,615 to Dobo et al.; and Canadian Patent Number 803,714 to Harmon.

Spunbond materials with desirable combinations of physical properties, especially combinations of softness, strength and absorbency, have been produced, but limitations have been encountered. For example, for some applications, polymeric materials such as polypropylene may have a desirable level of strength but not a desirable level of softness. On the other hand, materials such as polyethylene may, in some cases, have a desirable level of softness but not a desirable level of strength.

In an effort to produce nonwoven materials having desirable combinations of physical properties, multicomponent or bicomponent nonwoven polymeric fabrics have been developed. Methods for making bicomponent nonwoven materials are wellknown and are disclosed in patents such as U.S. Pat. No. Re. 30,955 of U.S. Pat. No. 4,068,036 to Stanistreet, U.S. Pat. No. 3,423,266 to Davies et al., and U.S. Pat. No. 3,595,731 to Davies et al. A bicomponent nonwoven polymeric fabric is made from polymeric fibers or filaments including first and second polymeric components which remain distinct. As used herein, filaments mean continuous strands of material and fibers mean cut or discontinuous strands having a definite length. The first and subsequent components of multicomponent filaments are arranged in substantially distinct zones across the cross-section of the filaments and extend continuously along the length of the filaments. Typically, one component exhibits different properties than the other so that the filaments exhibit properties of the two components. For example, one component may be polypropylene which is relatively strong and the other component may be polyethylene which is relatively soft. The end result is a strong yet soft nonwoven fabric.

U.S. Pat. No. 3,423,266 to Davies et al. and U.S. Pat. No. 3,595,731 to Davies et al. disclose methods for melt spinning bicomponent filaments to form nonwoven polymeric fabrics. The nonwoven webs may be formed by cutting the meltspun filaments into staple fibers and then forming a bonded carded web or by laying the continuous bicomponent filaments onto a forming surface and thereafter bonding the web.

To increase the bulk or fullness of the bicomponent nonwoven webs for improved fluid management performance or for enhanced "cloth-like" feel of the webs, the bicomponent filaments or fibers are often crimped. As disclosed in U.S. Pat. Nos. 3,595,731 and 3,423,266 to Davies et al., bicomponent filaments may be mechanically crimped and the resultant fibers formed into a nonwoven web or, if the appropriate polymers are used, a latent helical crimp produced in bicomponent fibers or filaments may be activated by heat treatment of the formed web. This heat treatment is used to activate the helical crimp in the fibers or filaments after the fibers or filaments have been formed into a nonwoven web.

One problem with fabrics made from helically crimped bicomponent filaments or fibers is that the web, when heat treated to activate the latent helical crimp, shrinks irregularly and becomes non-uniform. This problem is addressed in published European Patent Application Number 0,391,260 to Taiju et al. This reference discloses a method for melt spinning continuous bicomponent filaments to form a nonwoven web wherein an air stream is blown against the formed web from below the moving forming surface to float the web above the forming surface and disentangle the web from the forming surface before the web is heat treated to develop crimps and thermally bond the web. Although this process claims to produce a substantially uniform and highly crimped nonwoven fabric, it suffers from serious drawbacks in that it requires an additional process step, namely, floating the web above the forming surface, and is slow due to the long heating and bonding step which takes more than one minute. Such drawbacks add cost to the process making it impracticable for commercial use.

Therefore, there is a need for nonwoven materials having desirable levels of physical properties such as softness, strength, uniformity and absorbency, and efficient and economical methods for making the same.

SUMMARY OF THE INVENTION

Accordingly, an object of the present invention is to provide improved nonwoven fabrics and methods for making the same.

Another object of the present invention is to provide nonwoven fabrics with desirable combinations of physical properties such as softness, strength, uniformity, bulk or fullness, and absorbency, and methods for making the same.

Another object of the present invention is to provide nonwoven polymeric fabrics including highly crimped filaments and methods for economically making the same.

A further object of the present invention is to provide a method for controlling the properties of the resulting nonwoven polymeric fabric such as a degree of crimp.

Thus, the present invention provides a process for making nonwoven polymeric fabrics wherein continuous meltspun polymeric filaments are crimped before the continuous multicomponent filaments are formed into a nonwoven fabric web. By crimping the filaments before web formation, shrinkage of the web after formation is substantially reduced because most web shrinkage occurs due to fiber crimping. Thus, the resulting fabric is substantially stable and uniform. In addition, the resulting fabric can have a relatively high loft, if bonded properly, because the multicomponent filaments are helically crimped and, when treated to become hydrophillic, can have a relatively high absorbency.

More particularly, the process of the present invention for making a nonwoven fabric comprises the steps of:

a. melt spinning continuous multicomponent polymeric filaments comprising first and second polymeric components, the multicomponent filaments having a cross-section, a length, and a peripheral surface, the first and second components being arranged in substantially distinct zones across the cross-section of the multicomponent filaments and extending continuously along the length of the multicomponent filaments, the second component constituting at least a portion of the peripheral surface of the multicomponent filaments continuously along the length of the multicomponent filaments, the first and second components being selected so that the multicomponent filaments are capable of developing latent helical crimp;
b. drawing the multicomponent filaments;
c. at least partially quenching the multicomponent filaments so that the multicomponent filaments have latent helical crimp;
d. activating said latent helical crimp; and
e. thereafter, forming the crimped continuous multicomponent filaments into a first nonwoven fabric web.

Preferably, the step of activating the latent helical crimp includes heating the multicomponent filaments to a temperature sufficient to activate the latent helical crimp. More preferably, the step of activating the latent helical crimp includes contacting the multicomponent filaments with a flow of air having a temperature sufficiently high to activate the latent helical crimp. Even more preferably, the multicomponent filaments are drawn with the flow of air contacting the filaments and having a temperature sufficiently high to activate the latent helical crimp. By crimping the multicomponent filaments with the same flow of air used to draw the filaments, the filaments are crimped without an additional process step and without interrupting the process. Advantageously, this results in a faster, more efficient, and more economical process for producing crimped polymeric nonwoven fabric. Preferably, the multicomponent filaments are drawn with a fiber draw unit or aspirator by heated air at a temperature sufficient to heat the filaments to a temperature from about 110° F. to a maximum temperature less than the melting point of the lower melting component. However, it should be understood that the appropriate drawing air temperature to achieve the desired degree of crimping will depend on a number of factors including the type of polymers being used and the size of the filaments.

A variety of polymers may be used to form the first and second components of the filaments; however, the first and second components should be selected so that the multicomponent filaments are capable of developing latent helical crimp. One method of obtaining latent helical crimp is selecting the first and second components so that one of the first and second components has a melting point less than the melting point of the other component. Polyolefins such as polypropylene and polyethylene are preferred. The first component preferably comprises polypropylene or random copolymer of propylene and ethylene and the second component preferably includes polyethylene. Suitable polyethylenes include linear low density polyethylene and high density polyethylene. Even more particularly, the second component may include additives to enhance the crimp, abrasion resistance, strength, or adhesive properties of the fabric.

To achieve high crimp, the first and second components of the filaments are preferably arranged in a side-by-side arrangement or in an eccentric sheath/core arrangement, the first component being the core and the second component being the sheath.

After formation, the first nonwoven fabric web is preferably bonded by forming bonds between the multicomponent filaments to integrate the web. To produce a more lofty web, the components are selected so that the second component has a melting point less than the melting point of the first component and the web is bonded by contacting the web with air having a temperature below the melting point of the first component and greater than the melting point of the second component without substantially compressing the first web. To produce a more cloth-like web, the web is bonded with techniques such as the patterned application of heat and pressure, hydrogentangling, ultrasonic bonding, or the like.

According to another aspect of the present invention, the process for making a nonwoven fabric includes melt spinning and drawing continuous single polymeric component filaments together with the steps of melt spinning and drawing the multicomponent polymeric filaments, and incorporating the continuous single component filaments into the first nonwoven fabric web. The single component filaments may include one of the polymers of the first and second components of the multicomponent filaments.

According to yet another aspect of the present invention, the process for making a nonwoven fabric further comprises laminating a second nonwoven fabric web to the first nonwoven fabric web. More particularly, the second web includes multicomponent filaments and the filaments of the first web have a first degree of crimp and the filaments of the second web have a second degree of crimp which is different from the first degree of crimp. By varying the degree of crimp from the first web to the second web, the physical properties of webs may be controlled to produce composite webs with particular flow handling properties. Preferably, the second web is formed according to the process for making the first web except that the temperature of the air flow contacting the filaments of the second web is different from the temperature of the air flow contacting the filaments of the first web. Different air flow temperatures produce different degrees of crimp.

Still further objects and the broad scope of applicability of the present invention will become apparent to those of skill in the art from the details given hereinafter. However, it should be understood that the detailed description of the preferred embodiments of the present invention is given only by way of illustration because various changes and modifications well within the spirit and scope of the invention should become apparent to those of skill in the art in view of the following detailed description.

DETAILED DESCRIPTION OF THE INVENTION

As discussed above, the present invention provides a substantially uniform, high-loft or cloth-like polymeric fabric made from relatively highly crimped continuous, multicomponent, filaments. The present invention also comprehends a relatively efficient and economical process for making such fabric including the step of activating the latent helical crimp of the filaments before the continuous filaments are formed into a fabric web. Furthermore, the present invention comprehends a multilayer fabric in which adjacent layers have different degrees of crimp. Such a web can be formed by controlling the heating of the multicomponent filaments when activating the latent helical crimp to control the degree of crimp obtained.

The fabric of the present invention is particularly useful for making personal care articles and garment materials. Personal care articles include infant care products such as diposable baby diapers, child care products such as training pants, and adult care products such as incontinence products and feminine care products. Suitable garments include medical apparel, work wear, and the like.

The fabric of the present invention includes continuous multicomponent polymeric filaments comprising first and second polymeric components. A preferred embodiment of the present invention is a polymeric fabric including continuous bicomponent filaments comprising a first polymeric component A and a second polymeric component B. The bicomponent filaments have a cross-section, a length, and a peripheral surface. The first and second components A and B are arranged in substantially distinct zones across the cross-section of the bicomponent filaments and extend continuously along the length of the bicomponent filaments. The second component B constitutes at least a portion of the peripheral surface of the bicomponent filaments continuously along the length of the bicomponent filaments.

Figure 2A:
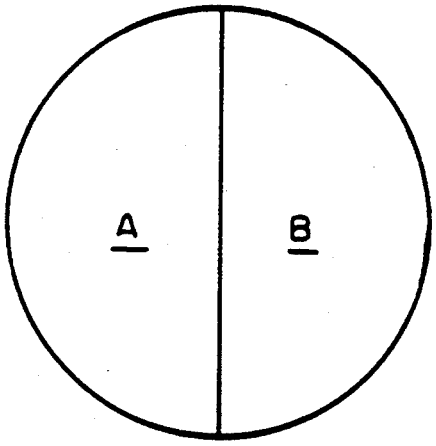
FIG. 2A is a schematic drawing illustrating the cross section of a filament made according to a preferred embodiment of the present invention with the polymer components A and B in a side-by-side arrangement.
Figure 2B:
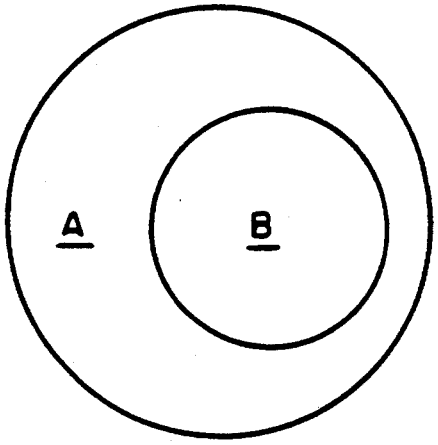
FIG. 2B is a schematic drawing illustrating the cross section of a filament made according to a preferred embodiment of the present invention with the polymer components A and B in an eccentric sheath/core arrangement.

The first and second components A and B are arranged in either a side-by-side arrangement as shown in FIG. 2A or an eccentric sheath/core arrangement as shown in FIG. 2B so that the resulting filaments exhibit a natural helical crimp. Polymer component A is the core of the filament and polymer component B is the sheath in the sheath/core arrangement. Methods for extruding multicomponent polymeric filaments into such arrangements are well-known to those of ordinary skill in the art.

A wide variety of polymers are suitable to practice the present invention including polyolefins (such as polyethylene and polypropylene), polyesters, polyamides, polyurethanes, and the like. Polymer component A and polymer component B must be selected so that the resulting bicomponent filament is capable of developing a natural helical crimp. Preferably, one of the polymer components A and B has a melting temperature which is greater than the melting temperature of the other polymer component. Furthermore, as explained below, polymer component B preferably has a melting point less than the melting point of polymer component A when the fabric of the present invention is through-air bonded.

Preferably, polymer component A comprises polypropylene or random copolymer of propylene and ethylene. Polymer component B preferably comprises polyethylene or random copolymer of propylene and ethylene. Preferred polyethylenes include linear low density polyethylene and high density polyethylene. In addition, polymer component B may comprise additives for enhancing the natural helical crimp of the filaments, lowering the bonding temperature of the filaments, and enhancing the abrasion resistance, strength and softness of the resulting fabric. For example, polymer component B may include 5 to 20% by weight of an elastomeric thermoplastic material such as an ABA' block copolymer of styrene, ethylene, and butylene. Such copolymers are available under the trade name KRATON from the Shell Company of Houston, Tx. KRATON block copolymers are available in several different formulations some of which are identified in U.S. Pat. No. 4,663,220 which is incorporated herein by reference. A preferred elastomeric block copolymer material is KRATON G 2740. Polymer component B may also include from about 2 to about 50% of an ethylene alkyl acrylate copolymer, such as ethylene n-butyl acrylate, to improve the aesthetics, softness, abrasion resistance and strength of the resulting fabric. Other suitable ethylene alkyl acrylates include ethylene methyl acrylate and ethylene ethyl acrylate. In addition, polymer component B may also include 2 to 50%, and preferably 15 to 30% by weight of a copolymer of butylene and ethylene to improve the softness of the fabric while maintaining the strength and durability of the fabric. Polymer component B may include a blend of polybutylene copolymer and random copolymer of propylene and ethylene.

Suitable materials for preparing the multicomponent filaments of the fabric of the present invention include PD-3445 polypropylene available from Exxon of Houston, Tx., random copolymer of propylene and ethylene available from Exxon, ASPUN 6811A and 2553 linear low density polyethylene available from Dow Chemical Company of Midland, Mich., 25355 and 12350 high density polyethylene available from Dow Chemical Company, Duraflex DP 8510 polybutylene available from Shell Chemical Company of Houston, Tx., and ENATHENE 720-009 ethylene n-butyl acrylate from Quantum Chemical Corporation of Cincinnati, Ohio.

When polypropylene is component A and polyethylene is component B, the bicomponent filaments may comprise from about 20 to about 80% by weight polypropylene and from about 20 to about 80% polyethylene. More preferably, the filaments comprise from about 40 to about 60% by weight polypropylene and from about 40 to about 60% by weight polyethylene.

Figure 1:
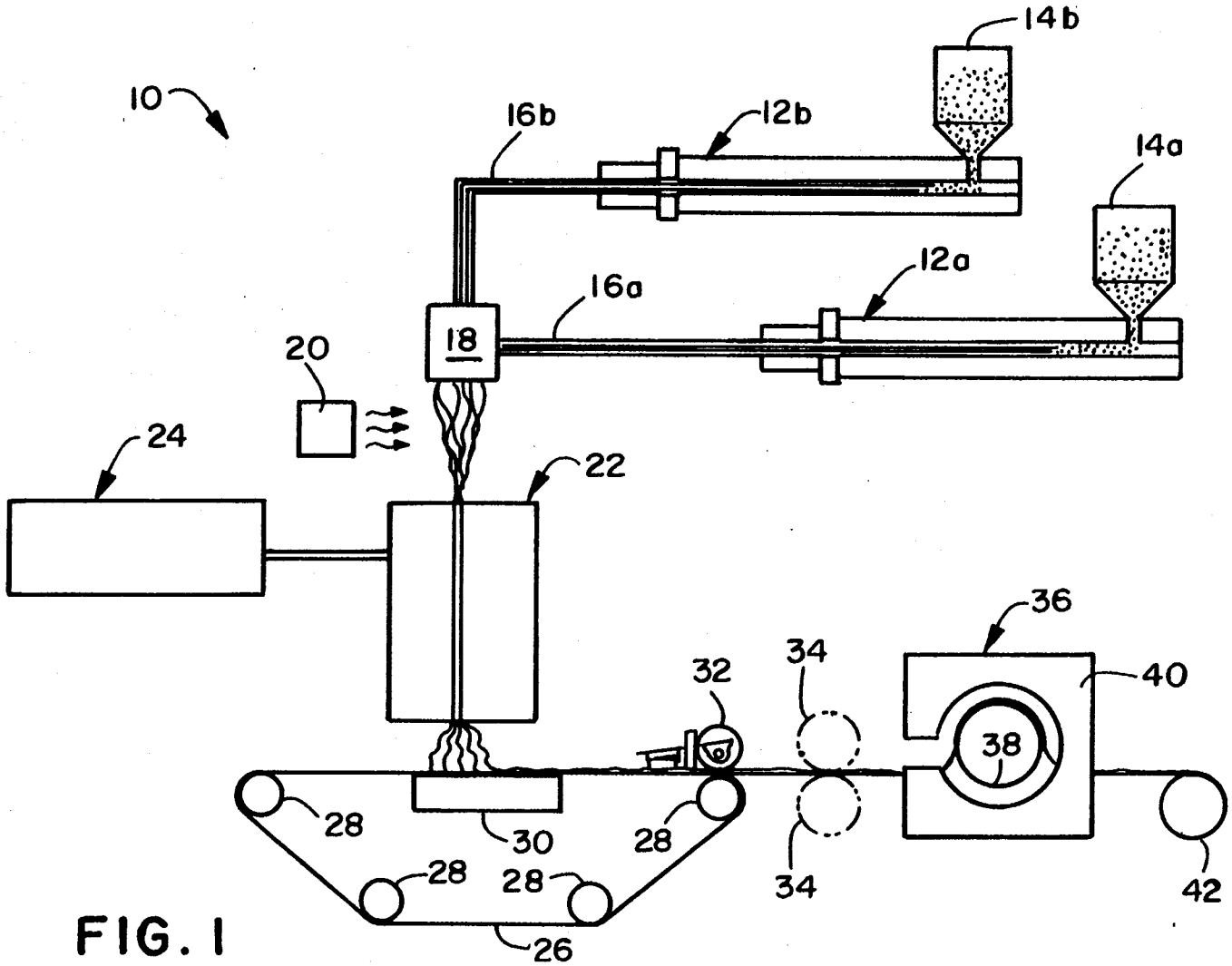
FIG. 1 is a schematic drawing of a process line for making a preferred embodiment of the present invention.

Turning to FIG. 1, a process line 10 for preparing a preferred embodiment of the present invention is disclosed. The process line 10 is arranged to produce bicomponent continuous filaments, but it should be understood that the present invention comprehends nonwoven fabrics made with multicomponent filaments having more than two components. For example, the fabric of the present invention can be made with filaments having three or four components. The process line 10 includes a pair of extruders **12*a* and 12*b* for separately extruding a polymer component A and a polymer component B. Polymer component A is fed into the respective extruder 12*a* from a first hopper 14*a* and polymer component B is fed into the respective extruder 12*b* from a second hopper 14*b*. Polymer components A and B are fed from the extruders 12*a* and 12*b* through respective polymer conduits 16*a* and 16*b* to a spinneret 18. Spinnerets for extruding bicomponent filaments are well-known to those of ordinary skill in the art and thus are not described here in detail. Generally described, the spinneret 18 includes a housing containing a spin pack which includes a plurality of plates stacked one on top of the other with a pattern of openings arranged to create flow paths for directing polymer components A and B separately through the spinneret. The spinneret 18 has openings arranged in one or more rows. The spinneret openings form a downwardly extending curtain of filaments when the polymers are extruded through the spinneret. For the purposes of the present invention, spinneret 18 may be arranged to formside-by-side or eccentric sheath/core bicomponent filaments illustrated in FIGS. 2A and 2B**.

The process line 10 also includes a quench blower 20 positioned adjacent the curtain of filaments extending from the spinneret 18. Air from the 14 bench air blower 20 quenches the filaments extending from the spinneret 18. The quench air can be directed from one side of the filament curtain as shown in FIG. 1, or both sides of the filament curtain.

A fiber draw unit or aspirator 22 is positioned below the spinneret 18 and receives the quenched filaments. Fiber draw units or aspirators for use in melt spinning polymers are well-known as discussed above. Suitable fiber draw units for use in the process of the present invention include a linear fiber aspirator of the type shown in U.S. Pat. No. 3,802,817 and eductive guns of the type shown in U.S. Pat. Nos. 3,692,618 and 3,423,266, the disclosures of which are incorporated herein by reference.

Generally described, the fiber draw unit 22 includes an elongate vertical passage through which the filaments are drawn by aspirating air entering from the sides of the passage and flowing downwardly through the passage. A heater 24 supplies hot aspirating air to the fiber draw unit 22. The hot aspirating air draws the filaments and ambient air through the fiber draw unit.

An endless foraminous forming surface 26 is positioned below the fiber draw unit 22 and receives the continuous filaments from the outlet opening of the fiber draw unit. The forming surface 26 travels around guide rollers 28. A vacuum 30 positioned below the forming surface 26 where the filaments are deposited draws the filaments against the forming surface.

The process line 10 further includes a compression roller 32 which, along with the forwardmost of the guide rollers 28, receive the web as the web is drawn off of the forming surface 26. In addition, the process line includes a bonding apparatus such as thermal point bonding rollers 34 (shown in phantom) or a through-air bonder 36. Thermal point bonders and through-air bonders are well-known to those skilled in the art and are not disclosed here in detail. Generally described, the through-air bonder 36 includes a perforated roller 38, which receives the web, and a hood 40 surrounding the perforated roller. Lastly, the process line 10 includes a winding roll 42 for taking up the finished fabric.

To operate the process line 10, the hoppers **14*a* and 14*b* are filled with the respective polymer components A and B. Polymer components A and B are melted and extruded by the respective extruders 12*a* and 12*b* through polymer conduits 16*a* and 16*b* and the spinneret 18**. Although the temperatures of the molten polymers vary depending on the polymers used, when polypropylene and polyethylene are used as components A and B respectively, the preferred temperatures of the polymers range from about 370° to about 530° F. and preferably range from 400° to about 450° F.

As the extruded filaments extend below the spinneret 18, a stream of air from the quench blower 20 at least partially quenches the filaments to develop a latent helical crimp in the filaments. The quench air preferably flows in a direction substantially perpendicular to the length of the filaments at a temperature of about 45° to about 90° F. and a velocity from about 100 to about 400 feet per minute.

After quenching, the filaments are drawn into the vertical passage of the fiber draw unit 22 by a flow of hot air from the heater 24 through the fiber draw unit. The fiber draw unit is preferably positioned 30 to 60 inches below the bottom of the spinneret 18. The temperature of the air supplied from the heater 24 is sufficient that, after some cooling due to mixing with cooler ambient air aspirated with the filaments, the air heats the filaments to a temperature required to activate the latent crimp. The temperature required to activate the latent crimp of the filaments ranges from about 110° F. to a maximum temperature less than the melting point of the lower melting component which for through-air bonded materials is the second component B. The temperature of the air from the heater 24 and thus the temperature to which the filaments are heated can be varied to achieve different levels of crimp. Generally, a higher air temperature produces a higher number of crimps. The ability to control the degree of crimp of the filaments is a particularly advantageous feature of the present invention because it allows one to change the resulting density, pore size distribution and drape of the fabric by simply adjusting the temperature of the air in the fiber draw unit.

The crimped filaments are deposited through the outlet opening of the fiber draw unit 22 onto the traveling forming surface 26. The vacuum 20 draws the filaments against the forming surface 26 to form an unbonded, nonwoven web of continuous filaments. The web is then lightly compressed by the compression roller 32 and then thermal point bonded by rollers 34 or through-air bonded in the through-air bonder 36. In the through-air bonder 36, air having a temperature above the melting temperature of component B and below the melting temperature of component A is directed from the hood 40, through the web, and into the perforated roller 38. The hot air melts the lower melting polymer component B and thereby forms bonds between the bicomponent filaments to integrate the web. When polypropylene and polyethylene are used as polymer components A and B respectively, the air flowing through the through-air bonder preferably has a temperature ranging from about 230° to about 280° F. and a velocity from about 100 to about 500 feet per minute. The dwell time of the web in the through-air bonder is preferably less than about 6 seconds. It should be understood, however, that the parameters of the through-air bonder depend on factors such as the type of polymers used and thickness of the web.

Lastly, the finished web is wound onto the winding roller 42 and is ready for further treatment or use. When used to make liquid absorbent articles, the fabric of the present invention may be treated with conventional surface treatments or contain conventional polymer additives to enhance the wettability of the fabric. For example, the fabric of the present invention may be treated with polyalkylene-oxide modified siloxanes and silanes such as polyalkylene-oxide modified polydimethyl-siloxane as disclosed in U.S. Pat. No. 5,057,361. Such a surface treatment enhances the wettability of the fabric.

Figure 3:
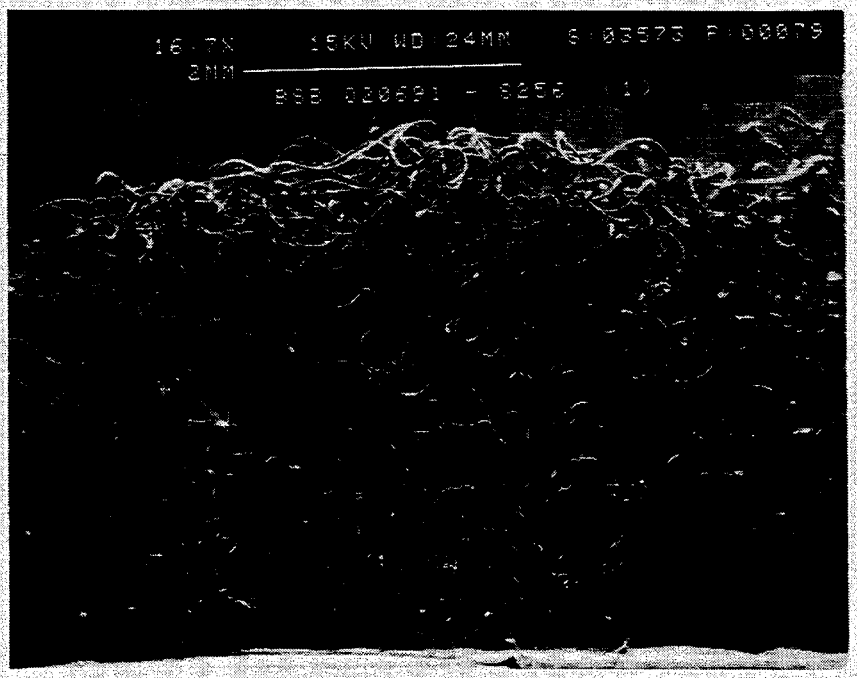
FIG. 3 is a photomicrograph of a partial cross-section of a through-air bonded sample of fabric made according to a preferred embodiment of the present invention.

When through-air bonded, the fabric of the present invention characteristically has a relatively high loft. As can be seen from FIG. 3, which shows a sample of through-air bonded fabric made according to a preferred embodiment of the present invention, the helical crimp of the filaments creates an open web structure with substantial void portions between filaments and the filaments are bonded at points of contact of the filaments. The through-air bonded web of the present invention typically has a density of 0.018 to 0.15 g/cc and a basis weight of 0.25 to about 5 oz. per square yard and more preferably 0.5 to 1.5 oz. per square yard. Fiber denier generally ranges from about 1.0 to about 8 dpf. The high loft through-air bonded fabric of the present invention is useful as a fluid management layer of personal care absorbent articles such as liner or surge materials in baby diapers and the like.

Figure 4:
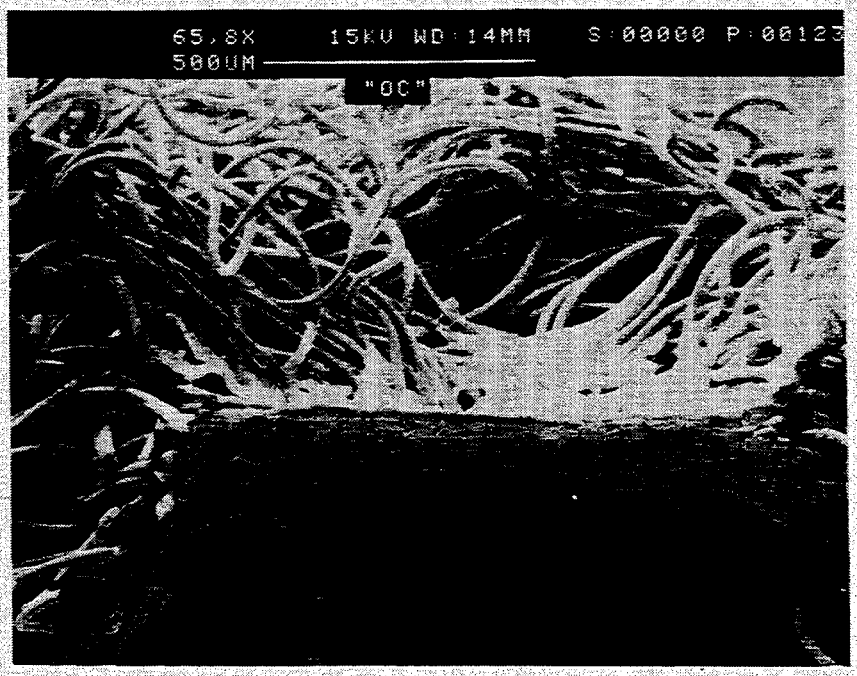
FIG. 4 is a photomicrograph of a partial cross-section of a point-bonded sample of fabric made according to a preferred embodiment of the present invention.

Thermal point bonding may be conducted in accordance with U.S. Pat. No. 3,855,046, the disclosure of which is incorporated herein by reference. When thermal point bonded, the fabric of the present invention exhibits a more cloth-like appearance and, for example, is useful as an outer cover for personal care articles or as a garment material. A thermal point bonded material made according to a preferred embodiment of the present invention is shown in FIG. 4. As can be seen in FIG. 4, helically crimped filaments of the point bonded material are fused together at spaced bond points.

Although the methods of bonding shown in FIG. 1 are thermal point bonding and through-air bonding, it should be understood that the fabric of the present invention may be bonded by other means such as oven bonding, ultrasonic bonding, or hydroentangling or combinations thereof. Such bonding techniques are well-known to those of ordinary skill in the art and are not discussed here in detail.

Figure 5:
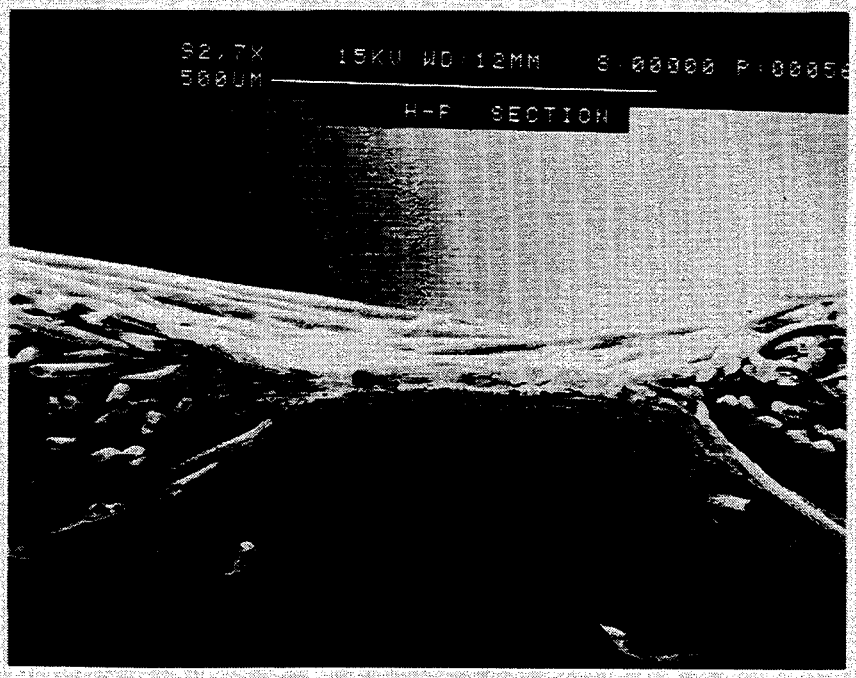
FIG. 5 is a photomicrograph of a partial cross-section of a comparative point-bonded sample of fabric made according to conventional ambient temperature drawing techniques.

FIGS. 5 illustrate a comparative fabric sample made with ambient temperature drawing techniques. As can be seen, the fabric is made of substantially straight or non-crimped filaments.

According to another aspect of the present invention, non-multicomponent filaments or multicomponent or single component staple length fibers may be incorporated into the web. Another fabric of the present invention is made by melt spinning and drawing continuous single polymeric component filaments together with melt spinning and drawing the bicomponent polymeric filaments and incorporating the continuous single component filaments into a single web with the bicomponent filaments. This is achieved by extruding the bicomponent and single component filaments through the same spinneret. Some of the holes used in the spinneret are used to extrude bicomponent filaments while other holes in the same spinneret are used to extrude single component filaments. Preferably, the single component filaments include one of the polymers of the components of the bicomponent filaments.

Figure 6:
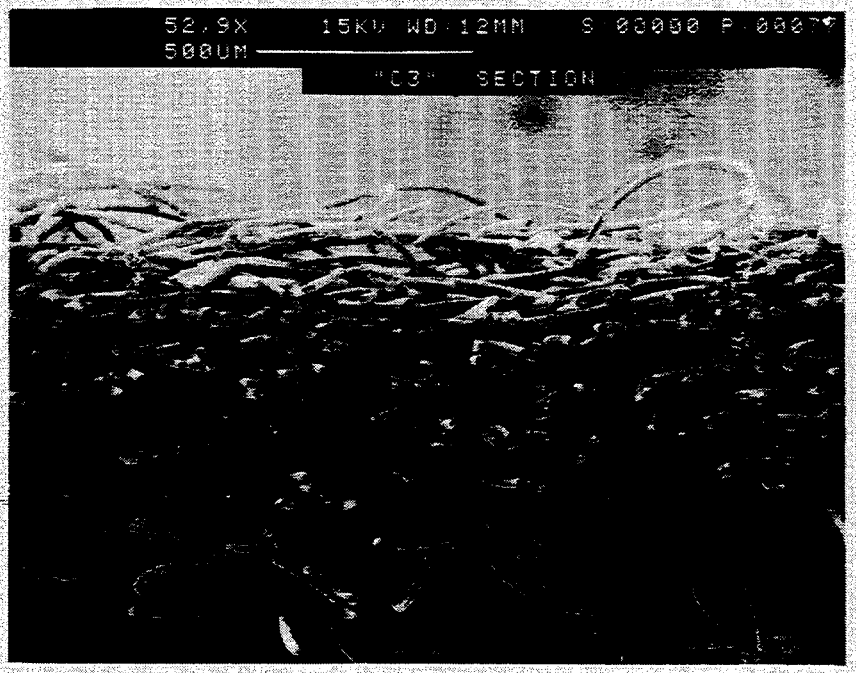
FIG. 6 is a photomicrograph of a partial cross-section of a multilayer fabric made according to a preferred embodiment of the present invention.

According to still another aspect of the present invention, a multilayer nonwoven fabric is made by laminating second and third nonwoven fabric webs to a first nonwoven fabric web such as is made with the process line 10 described above. Such a multilayer fabric made according to a preferred embodiment of the present invention is illustrated in FIG. 6. As can be seen, the multilayer fabric includes three layers of nonwoven fabric including multicomponent filaments having differing degrees of crimp. Advantageously, the process of the present invention can be used to produce each of such webs, and, by controlling the temperature of the mixed air in the fiber draw unit, can vary the degree of crimp between the webs. The webs may be formed separately and then laminated together or one web may be formed directly on top of another preformed web, or the webs may be formed in series, simultaneously, by placing fiber draw units in series. Although the composite fabric has three layers, it should be understood that the composite fabric of the present invention may include 2, 4, or any number of layers having different degrees of crimp.

By varying the degree of crimp from layer to layer of the fabric, the resulting fabric has a density or pore size gradient for improved liquid handling properties. For example, a multilayer fabric can be made such that the outer layer has relatively large pore sizes while the inner layer has small pore sizes so that liquid is drawn by capillary action through the more porous outer layer into the more dense inner layer. In addition, polymer type and filament denier may be altered from layer to layer to affect the liquid handling properties of the composite web.

Although the preferred method of carrying out the present invention includes contacting the multicomponent filaments with heated aspirating air, the present invention encompasses other methods of activating the latent helical crimp of the continuous filaments before the filaments are formed into a web. For example, the multicomponent filaments may be contacted with heated air after quenching but upstream of the aspirator. In addition, the multicomponent filaments may be contacted with heated air between the aspirator and the web forming surface. Furthermore, the filaments may be heated by methods other than heated air such as exposing the filaments to electromagnetic energy such as microwaves or infrared radiation.

The following Examples 1–7 are designed to illustrate particular embodiments of the present invention and to teach one of ordinary skill in the art the manner of carrying out the present invention. Comparative Examples 1 and 2 are designed to illustrate the advantages of the present invention. Examples 1–7 and Comparative Examples 1 and 2 were carried out in accordance with the process illustrated in FIG. 1 using the parameters set forth in Tables 1–4. In Tables 1–4, PP means polypropylene, LLDPE means linear low density polyethylene, HDPE means high density polyethylene and S/S means side-by-side, QA means quench air. TiO2 represents a concentrate comprising 50% by weight TiO2 and 50% by weight polypropylene. The feed air temperature is the temperature of the air from the heater 24 entering the draw unit 22. Where given, the mixed air temperature is the temperature of the air in the draw unit 22 contacting the filaments. In addition, crimp was measured according to ASTM D-3937-82, caliper was measured at 0.5 psi with a Starret-type bulk tester and density was calculated from the caliper. Grab tensile was measured according to ASTM 1682 and drape stiffness was measured according to ASTM D-1388.

TABLE 1

| | Comp. Ex. 1 | Ex. 1 | Ex. 2 | Ex. 3 |
|---|---|---|---|---|
| Filament Configuration | Round S/S | Round S/S | Round S/S | Round S/S |
| Spinhole Geometry | .6 mm D, 4:1 L/D | .6 mm D, 4:1 L/D | .6 mm D, 4:1 L/D | .6 mm D, 4:1 L/D |
| Polymer A | 98% Exxon 3445 PP, 2% $TiO_2$ | 98% Exxon 3445 PP, 2% $TiO_2$ | 98% Exxon 3445 PP, 2% $TiO_2$ | 98% Exxon 3445 PP, 2% $TiO_2$ |
| Polymer B | 98% Dow 6811A LLDPE, 2% $TiO_2$ | 98% Dow 6811A LLDPE, 2% $TiO_2$ | 98% Dow 6811A LLDPE, 2% $TiO_2$ | 98% Dow 6811A LLDPE, 2% $TiO_2$ |
| Ratio A/B | 50/50 | 50/50 | 50/50 | 50/50 |
| Melt Temp (°F.) | — | 450° F. | 450° F. | 450° F. |
| Spinhole Thruput (GHM) | 0.7 | 0.6 | 0.6 | 0.6 |
| QA Flow (SCFM) | — | 25 | 25 | 20 |
| QA Temp (°F.) | — | 65 | 65 | 65 |
| Feed Air Temp (°F.) | 65 | 160 | 255 | 370 |
| Bond Type | Thru-Air | Thru-Air | Thru-Air | Thru-Air |
| Basis Wt. (osy) | 1.0 | 1.4 | 1.6 | 1.5 |
| Denier | 3.2 | 3.0 | 3.0 | 3.0 |
| Crimp Type | Helical | Helical | Helical | Helical |
| Density (g/cc) | 0.058 | 0.047 | 0.032 | 0.025 |
| Caliper (in) | 0.023 | 0.044 | 0.066 | 0.080 |

As can be seen from Table 1, as the aspirator feed air temperature was increased from the ambient temperature of 65° F. in Comparative Example 1 to the elevated temperatures of Examples 1–3, the web density decreased and the web thickness increased. Thus, at the higher aspirator feed air temperatures, the webs became more lofty and highly crimped.

TABLE 2

| | Comp. Ex. 2 | Ex. 4 |
|---|---|---|
| Filament Configuration | Round S/S | Round S/S |
| Spinhole Geometry | .6 mm D, 4:1 L/D | .6 mm D, 4:1 L/D |
| Polymer A | 98% Exxon 3445 PP, 2% $TiO_2$ | 98% Exxon 3445 PP, 2%-$TiO_2$ |
| Polymer B | 98% Dow 6811A LLDPE, 2% $TiO_2$ | 98% Dow 6811A LLDPE, 2% $TiO_2$ |
| Ratio A/B | 50/50 | 50/50 |
| Melt Temp (°F.) | 445° F. | 445° F. |
| Spinhole Thruput (GHM) | 0.7 | 0.7 |
| QA Flow (SCFM) | 25 | 25 |
| QA Temp (°F.) | — | 65 |
| Feed Air Temp (°F.) | 70 | 375 |
| Bond Type | Thru-Air | Thru-Air |
| Basis Wt. (osy) | 1.0 | 1.0 |
| Denier | 3.0 | 3.0 |
| Crimp/Inch Extended | 8.5 | 16.0 |
| Crimp Type | Helical | Helical |
| Density (g/cc) | 0.052 | 0.029 |
| Caliper (in) | 0.026 | 0.053 |
| Grab Tensile | | |
| MD (lbs) | 7.3 | 4.1 |
| CD (lbs) | 8.1 | 3.2 |

TABLE 3

| | Ex. 5 | Ex. 6 |
|---|---|---|
| Filament Configuration | Round S/S | Round S/S |
| Spinhole Geometry | .6 mm D, 4:1 L/D | .6 mm D, 4:1 L/D |
| Polymer A | 98% Exxon 3445 PP, 2% $TiO_2$ | 98% Exxon 3445 PP, 2% $TiO_2$ |
| Polymer B | 98% Dow 6811A LLDPE, 2% $TiO_2$ | 98% Dow 6811A LLDPE, 2% $TiO_2$ |
| Ratio A/B | 50/50 | 50/50 |
| Melt Temp (°F.) | 440° F. | 440° F. |
| Spinhole Thruput (GHM) | 0.7 | 0.7 |
| QA Flow (SCFM) | 25 | 25 |

TABLE 3-continued

| | Ex. 5 | Ex. 6 |
|---|---|---|
| QA Temp (°F.) | 65 | 65 |
| Feed Air Temp (°F.) | 121 | 318 |
| Bond Type | Thru-Air | Thru-Air |
| Bond Temp (°F.) | 257 | 262 |
| Basis Wt. (osy) | 1.5 | 1.5 |
| Denier | 4.0 | 4.0 |
| Crimp Type | Helical | Helical |
| Density (g/cc) | 0.057 | 0.027 |
| Caliper (in) | 0.035 | 0.074 |

Tables 2 and 3 also show the effects of increasing the aspirator feed temperature. By increasing the aspirator feed air temperature from 70° F. in Comparative Example 2 to 375° F. in Example 4, the degree of helical crimp nearly doubled, the web density decreased and the web thickness increased. The same effects were seen with Examples 5 and 6 as shown in Table 3.

TABLE 4

| | LAYER A | LAYER B | LAYER C | COMPOSITE |
|---|---|---|---|---|
| Filament Configuration | Round S/S | Round S/S | Round S/S | — |
| Spinhole Geometry | .6 mm D, 4:1 L/D | .6 mm D, 4:1 L/D | .6 mm D, 4:1 L/D | — |
| Polymer A | 98% Exxon 3445 PP, 2% $TiO_2$ | 98% Exxon 3445 PP, 2% $TiO_2$ | 98% Exxon 3445 PP, 2% $TiO_2$ | — |
| Polymer B | 98% Dow 6811A LLDPE, .5% $TiO_2$ | 98% Dow 6811A LLDPE, .5% $TiO_2$ | 98% Dow 6811A LLDPE, .5% $TiO_2$ | — |
| Ratio A/B | 50/50 | 50/50 | 50/50 | |
| Melt Temp (°F.) | 450° F. | 450° F. | 450° F. | — |
| Spinhole Thruput (GHM) | 0.6 | 0.6 | 0.7 | — |
| QA Flow (SCFN) | 20 | 25 | N/A | — |
| QA Temp (°F.) | 70 | 70 | 70 | — |
| Feed Air Temp (°F.) | 370 | 160 | 70 | — |
| Bond Type | Thru-Air | Thru-Air | Thru-Air | — |
| Basis Wt. (osy) | 0.7 | 0.7 | 0.7 | 2.1 |
| Denier | 3.0 | 3.0 | 3.0 | — |
| Crimp Type | Helical | Helical | Helical | — |
| Density (g/cc) | 0.032 | 0.050 | 0.06 | — |
| Caliper (in) | 0.029 | 0.019 | 0.016 | 0.064 |

Example 7, shown in Table 4, resulted in a 3-layer composite web including layers A–C. As can be seen, the density of the webs increased and the thickness of the webs decreased as the temperature of the aspirator air decreased. The resulting fabric therefore had a density and pore size gradient from layers A to B to C.

TABLE 5

| | Ex. 8 | Ex. 9 | Ex. 10 | Ex. 11 | Ex. 12 |
|---|---|---|---|---|---|
| Filament Configuration | Round S/S | Round S/S | Round S/S | Round S/S | Round S/S |
| Spinhole Geometry | .6 mm D, 4:1 L/D | .6 mm D, 4:1 L/D | .6 mm D, 4:1 L/D | .6 mm D, 4:1 L/D | .6 mm D, 4:1 L/D |
| Polymer A | 98% Exxon 3445 PP, 2% $TiO_2$ | 98% Exxon 3445 PP, 2% $TiO_2$ | 98% Exxon 3445 PP, 2% $TiO_2$ | 98% Exxon 3445 PP, 2% $TiO_2$ | 98% Exxon 3445 PP, 2% $TiO_2$ |
| Polymer 8 | 98% Dow 6811A LLDPE 2% $TiO_2$ | 98% Dow 6811A LLDPE 2% $TiO_2$ | 98% Dow 6811A LLDPE 2% $TiO_2$ | 98% Dow 6811A LLDPE 2% $TiO_2$ | 98% Dow 6811A PE 2% $TiO_2$ |
| Ratio A/B | 50/50 | 50/50 | 50/50 | 50/50 | 50/50 |
| Melt Temp (°F.) | 448 | 448 | 448 | 448 | 448 |
| Spinhole Thruput (GHM) | 0.6 | 0.6 | 0.6 | 0.6 | 0.6 |
| QA Flow (SCFM) | 20 | 20 | 20 | 20 | 20 |
| QA Temp (°F.) | 60 | 60 | 60 | 60 | 60 |
| Feed Air Temp (°F.) | 357 | 298 | 220 | 150 | 120 |
| Mixed Air Temp | 218 | 189 | 148 | 114 | 99 |
| Bond Type | Thru-Air | Thru-Air | Thru-Air | Thru-Air | Thru-Air |
| Bond Temp (°F.) | 258 | 258 | 258 | 258 | 258 |
| Basis Wt. (osy) | 1.57 | 1.55 | 1.50 | 1.6 | 1.56 |
| Denier | 3.0 | 3.0 | 3.0 | 3.0 | 3.0 |
| Crimp/Inch Extended | 7.1 | 5.3 | 4.0 | 3.9 | 4.1 |
| Crimp Type | Helical | Helical | Helical | Helical | Helical |
| Density (g/cc) | 0.022 | 0.037 | 0.047 | 0.054 | 0.067 |
| Caliper (in) | 0.090 | 0.055 | 0.043 | 0.038 | 0.030 |

Table 5 further illustrates the effect of increasing the aspirator feed air temperature on the degree of crimp of the filaments and the density and caliper of the resulting webs. Table 5 includes data on the crimps/inch extended of the filaments and the temperature of the mixed air in the aspirator in addition to the temperature of the aspirator feed air. As can be seen, the degree of crimp of the filament increases as the temperature of the aspirating air increases.

TABLE 6

| | Ex. 13 | Ex. 14 | Ex. 15 | Ex. 16 | Ex. 17 |
|---|---|---|---|---|---|
| Filament Configuration | Round S/S | Round S/S | Round S/S | Round S/S | Round S/S |
| Spinhole Geometry | .6 mm D, 4:1 L/D | .6 mm D, 4:1 L/D | .6 mm D, 4:1 L/D | .6 mm D, 4:1 L/D | .6 mm D, 4:1 L/D |
| Polymer A | 98% Exxon 3445 PP, 2% $TiO_2$ | 98% Exxon 3445 PP, 2% $TiO_2$ | 98% Exxon 3445 PP, 2% $TiO_2$ | 98% Exxon 3445 PP, 2% $TiO_2$ | 98% Exxon 3445 PP, 2% $TiO_2$ |
| Polymer B | 98% Dow 6811A LLDPE 2% $TiO_2$ | 98% Dow 6811A LLDPE 2% $TiO_2$ | 98% Dow 6811A LLDPE 2% $TiO_2$ | 98% Dow 6811A LLDPE 2% $TiO_2$ | 98% Dow 6811A LLDPE 2% $TiO_2$ |
| Ratio A/B | 50/50 | 50/50 | 50/50 | 50/50 | 50/50 |
| Melt Temp (°F.) | 449 | 449 | 449 | 449 | 449 |
| Spinhole Thruput (GHM) | 0.6 | 0.6 | 0.6 | 0.6 | 0.6 |
| QA Flow (SCFM) | 20 | 20 | 20 | 20 | 20 |
| QA Temp (°F.) | 60 | 60 | 60 | 60 | 60 |
| Feed Air Temp (°F.) | 357 | 298 | 220 | 150 | 120 |
| Bond Type | Thermal Point | Thermal Point | Thermal Point | Thermal Point | Thermal Point |
| Bond Temp (°F.) | 245 | 245 | 245 | 245 | 245 |
| Basis Wt. (osy) | 1.5 | 1.5 | 1.5 | 1.5 | 1.5 |
| Denier | 3.1 | 3.1 | 3.1 | 3.1 | 3.1 |
| Crimp/Inch Extended | 7.55 | 5.14 | 5.32 | 4.32 | 3.49 |
| Crimp Type | Helical | Helical | Helical | Helical | Helical |
| MD Drape Stiffness (cm) | 2.9 | 3.16 | 3.53 | 3.60 | 4.05 |

Table 6 contains the properties of thermal point bonded fabrics made with heated aspirating air. Like the previous examples, the degree of crimp of the filaments increased with increasing aspirating air temperature. In addition, however, the thermal point bonded sample exhibited increased softness with increasing aspirating air temperature as shown by the Drape Stiffness values which decrease with increasing aspirating air temperature. The thermal point bonded samples had a bond pattern with 250 bond points per square inch and a total bond area of 15%

TABLE 7

| | Ex. 18 | Ex. 19 |
|---|---|---|
| Filament Configuration | Round S/S | Round S/S |
| Spinhole Geometry | .6 mm D, 4:1 L/D | .6 mm D, 4:1 L/D |
| Polymer A | 98% Exxon 3445 PP, 2% $TiO_2$ | 98% Exxon 3445 PP, 2% $TiO_2$ |
| Polymer B | 98% Dow 2553 LLDPE 2% $TiO_2$ | 98% Dow 2553 LLDPE 2% $TiO_2$ |
| Ratio A/B | 50/50 | 50/50 |
| Melt Temp (°F.) | 450 | 450 |
| Spinhole Thruput (GHM) | 0.8 | 0.6 |
| QA Flow (SCFM) | 18 | 18 |
| QA Temp (°F.) | 60 | 60 |
| Feed Air Temp (°F.) | 350 | 350 |
| Bond Type | Thru-Air | Thru-Air |
| Bond Temp (°F.) | 258 | 258 |
| Basis Wt. (osy) | 1.5 | 1.5 |
| Denier | 3.4 | 3.2 |
| Crimp/Inch Extended | 10.3 | 8.4 |
| Crimp Type | Helical | Helical |
| Density (g/cc) | 0.027 | 0.033 |
| Caliper (in) | 0.075 | 0.060 |

TABLE 8

| | Ex. 20 | Ex. 21 | Ex. 22 |
|---|---|---|---|
| Filament Configuration | Round S/S | Round S/S | Round S/S |
| Spinhole Geometry | .6 mm D, 4:1 L/D | .6 mm D, 4:1 L/D | .6 mm D, 4:1 L/D |
| Polymer A | 98% Exxon 3445 PP, 2% $TiO_2$ | 98% Exxon 3445 PP, 2% $TiO_2$ | 98% Exxon 3445 PP, 2% $TiO_2$ |
| Polymer B | 98% Dow 25355 HDPE 2% $TiO_2$ | 98% Dow 25355 HDPE 2% $TiO_2$ | 98% Dow 12350 HDPE 2% $TiO_2$ |
| Ratio A/B | 50/50 | 50/50 | 50/50 |
| Melt Temp (°F.) | 430 | 430 | 430 |
| Spinhole Thruput (GHM) | 0.8 | 0.6 | 0.6 |
| QA Flow (SCFM) | 18 | 20 | 20 |
| QA Temp (°F.) | 60 | 60 | 60 |
| Feed Air Temp (°F.) | 350 | 375 | 350 |
| Bond Type | Thru-Air | Thru-Air | Thru-Air |
| Bond Temp (°F.) | 264 | 264 | 259 |
| Basis Wt. (osy) | 1.5 | 1.4 | 1.5 |
| Denier | 4.6 | 2.9 | 2.5 |
| Crimp/Inch Extended | 7.1 | 7.9 | 6.4 |
| Crimp Type | Helical | Helical | Helical |
| Density (g/cc) | 0.025 | 0.023 | 0.033 |
| Caliper (in) | 0.081 | 0.086 | 0.060 |

TABLE 9

| | Comp. Ex. 1 |
|---|---|
| Filament Configuration | Round S/S 50% Homofilament 50% |
| Spinhole Geometry | .6 mm D, 4:1 L/D |
| Polymer A | 98% Exxon 3445 PP, 2% $TiO_2$ |
| Ratio A/B | 50/50 |
| Polymer B | 98% Dow |

TABLE 9-continued

| | Comp. Ex. 1 |
|---|---|
| | 6811A LLDPE, 2% $TiO_2$ |
| Melt Temp (°F.) | 450 |
| Spinhole Thruput (GHM) | 0.6 |
| QA Flow (SCFM) | 27 |
| QA Temp (°F.) | 60 |
| Feed Air Temp (°F.) | 350 |
| Bond Type | Thru-Air |
| Bond Temp (°F.) | 260 |
| Basis Wt. (osy) | 1.68 |
| Denier | 2.0 |
| Crimp/Inch Extended | 4.7 |
| Crimp Type | Helical |
| Density (g/cc) | 0.062 |
| Caliper (in) | 0.036 |

Table 7 illustrates samples of fabric made with a higher melt index (40 MI) 2553 linear low density polyethylene in the second component B. The 6811A linear low density polyethylene had a melt index of 26 MI. As can be seen, the resulting fabric comprised relatively highly crimped filaments.

Table 8 illustrates samples of fabric made with high density polyethylene in the second component B. The melt flow index of the DOW 25355 HDPE was 25 and the melt flow index of the DOW 12350 HDPE was 12. The resulting fabrics comprised relatively highly crimped filaments.

Table 9 illustrates our sample of fabric comprising 50% by weight highly crimped bicomponent filaments and 50% by weight polypropylene homofilaments. The homofilaments had the same composition as component A of the bicomponent filaments and were drawn simultaneously with the bicomponent filaments with the same spinneret. The crimps per inch extended is the average of the crimped bicomponent filaments and the non-crimped homofilaments.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

We claim:

1. A nonwoven fabric made according to a process comprising the steps of:

a. melt spinning continuous multicomponent polymeric filaments comprising first and second polymeric components, the multicomponent filaments having a cross-section, a length, and a peripheral surface, the first and second components being arranged in substantially distinct zones across the cross-section of the multicomponent filaments and extending continuously along the length of the multicomponent filaments, the second component constituting at least a portion of the peripheral surface of the multicomponent filaments continuously along the length of the multicomponent filaments, the first and second components being selected so that the multicomponent filaments are capable of developing latent helical crimp;

b. drawing the multicomponent filaments;

c. at least partially quenching the multicomponent filaments so that the multicomponent filaments have latent helical crimp;

d. activating said latent helical crimp; and e. thereafter, forming the crimped continuous multicomponent filaments into a first nonwoven fabric web.

2. A nonwoven fabric made according to a process as in claim 1 wherein the crimp activating step comprises heating the multicomponent filaments to a temperature sufficiently high to activate said latent helical crimp.

3. A nonwoven fabric made according to a process as in claim 1 wherein the crimp activating step comprises contacting the multicomponent filaments with a flow of air having a temperature sufficiently high to activate said latent helical crimp.

4. A nonwoven fabric made according to a process as in claim 3, wherein the drawing step includes drawing the multicomponent filaments with the flow of air contacting the filaments and having a temperature sufficiently high to activate said latent helical crimp.

5. A nonwoven fabric made according to a process as in claim 1, further comprising the step of forming bonds between the multicomponent filaments to integrate the first nonwoven fabric web.

6. A nonwoven fabric made according to a process as in claim 5, wherein the first component has a melting point and the second component has a melting point and the bonding step includes contacting the first web with air having a temperature below the melting point of the first component and greater than the melting point of the second component without substantially compressing the first web.

7. A nonwoven fabric made according to a process as in claim 5, wherein the bonding step includes patterned application of heat and pressure.

8. A nonwoven fabric made according to a process as in claim 5, wherein the bonding step includes hydroentangling.

9. A nonwoven fabric made according to a process as in claim 3, wherein the first component has a melting point and the second component has a melting point and the contacting air temperature is sufficient to heat the multicomponent filaments to a temperature from about 110° F. to a maximum temperature less than the melting point of the first component and the melting point of the second component.

10. A nonwoven fabric made according to a process as in claim 1, wherein the first component has a melting point and the second component has a melting point less than the melting point of the first component.

11. A nonwoven fabric made according to a process as in claim 1, wherein the first component includes a polymer selected from the group consisting of polypropylene and random copolymer of propylene and ethylene and the second component includes polyethylene.

12. A nonwoven fabric made according to a process as in claim 1, wherein the first component includes a polymer selected from the group consisting of polypropylene and random copolymer of propylene and ethylene and the second component includes a polymer selected from the group consisting of linear low density polyethylene and high density polyethylene.

13. A nonwoven fabric made according to a process as in claim 1, wherein the first and second components are arranged side-by-side.

14. A nonwoven fabric made according to a process as in claim 1, wherein the first and second components are arranged in an eccentric sheath/core arrangement, the first component being the core and the second component being the sheath.

15. A nonwoven fabric made according to a process as in claim 1, further comprising the steps of:

a. melt spinning and drawing continuous single polymeric component filaments together with the steps of melt spinning and drawing the multicomponent polymeric filaments; and b. incorporating the continuous single component filaments into the nonwoven fabric web.

16. A nonwoven fabric made according to a process as in claim 1, further comprising the step of laminating a second nonwoven fabric web to the first nonwoven fabric web.

17. A nonwoven fabric made according to a process as in claim 16, wherein the second web comprises multicomponent filaments, the filaments of the first web having a first degree of crimp and the filaments of the second web having a second degree of crimp different from the first degree of crimp.

18. A nonwoven fabric made according to a process as in claim 17, wherein the second web is formed according to the process defined in claim 31 except that the temperature of the flow of air contacting the filaments of the second web is different from the temperature of the flow of air contacting the filaments of the first web, whereby the first degree of crimp is different from the second degree of crimp.

19. A nonwoven fabric made according to a process as in claim 18, wherein the first and second webs are formed in a single process line, one of the first and second webs being formed on top of the other.

20. A nonwoven fabric made according to a process as in claim 18, wherein the drawing step in forming the first and second webs includes drawing the multicomponent filaments with the flow of air contacting the filaments.

21. A nonwoven fabric made according to a process as in claim 18, further comprising the step of forming bonds between the multicomponent filaments of the first and second webs.

22. A nonwoven fabric made according to a process as in claim 21, wherein the first components of the first and second webs have respective melting points and the second components of the first and second webs have respective melting points and the bonding step includes contacting the first and second webs with air having a temperature below the melting points of the first components and greater than the melting points of the second components without substantially compressing the first and second webs.

23. A nonwoven fabric made according to a process as in claim 21, wherein the bonding step includes patterned application of heat and pressure.

24. A nonwoven fabric made according to a process as in claim 21, wherein the bonding step includes hydroentangling.

25. A nonwoven fabric made according to a process as in claim 18, wherein the first components of the first and second webs include a polymer selected from the group consisting of polypropylene and random copolymer of propylene and ethylene and the second components of the first and second webs include polyethylene.

26. A nonwoven fabric made according to a process as in claim 18, wherein the first components of the first and second webs include a polymer selected from the group consisting of polypropylene and random copolymer of propylene and ethylene and the second components of the first and second webs include a polymer selected from the group consisting of linear low density polyethylene and high density polyethylene.

27. A nonwoven fabric made according to a process as in claim 18, wherein the first and second components are arranged side-by-side.

28. A nonwoven fabric made according to a process as in claim 18, wherein the first and second components are arranged in an eccentric sheath/core arrangement, the first component being the core and the second component being the sheath.

29. A nonwoven fabric comprising a plurality of nonwoven fabric webs laminated to one another, each nonwoven web comprising continuous multicomponent polymeric filaments comprising first and second polymeric components, the multicomponent filaments having a cross-section, a length, and a peripheral surface, the first and second components being arranged in substantially distinct zones across the cross-section of the multicomponent filaments and extending continuously along the length of the multicomponent filaments, the second component constituting at least a portion of the peripheral surface of the multicomponent filaments continuously along the length of the multicomponent filaments, the plurality of webs including first and second webs, the multicomponent filaments of the first web having a first degree of helical crimp and the multicomponent filaments of the second web having a second degree of helical crimp different than the first degree of helical crimp.

30. A nonwoven fabric as in claim 29, wherein at least one of the first and second polymeric components of the first web is different than the corresponding one of the first and second polymeric components of the second web.

31. A nonwoven fabric as in claim 29, wherein the multicomponent filaments of the first web have a first denier and the multicomponent filaments of the second web have a second denier different than the first denier.

32. A nonwoven fabric as in claim 29, wherein at least one of the first and second polymeric components of the first web is different than the corresponding one of the first and second polymeric components of the second web and the multicomponent filaments of the first web have a first denier and the multicomponent filaments of the second web have a second denier different than the first denier.

33. A nonwoven fabric as in claim 30, wherein the first and second nonwoven fabric webs are integrated by bonds formed between the multicomponent filaments.

34. A nonwoven fabric as in claim 33, wherein the first component of each web has a melting point and the second component of each web has a melting point and the bonds between the multicomponent filaments are formed by contacting the first web with air having a temperature below the melting point of the respective first component and greater than the melting point of the respective second component without substantially compressing the first web and contacting the second web with air having a temperature below the melting point of the respective first component and greater than the melting point of the respective second component without substantially compressing the second web.

35. A nonwoven fabric as in claim 33, wherein the bonds between the multicomponent filaments are formed by patterned application of heat and pressure.

36. A nonwoven fabric as in claim 30, wherein the bonds between the multicomponent filaments are formed by hydroentangling.

37. A nonwoven fabric as in claim 29, wherein the first component of each web includes a polymer selected from the group consisting of polypropylene and random copolymer of propylene and ethylene and the second component of each web includes polyethylene.

38. A nonwoven fabric as in claim 29, wherein the first component of each web includes a polymer selected from the group consisting of polypropylene and random copolymer of propylene and ethylene and the second component of each web includes a polymer selected from the group consisting of linear low density polyethylene and high density polyethylene.

39. A nonwoven fabric comprising:

continuous multicomponent polymeric filaments comprising first and second polymeric components, the multicomponent filaments having a cross-section, a length, and a peripheral surface, the first and second components being arranged in substantially distinct zones across the cross-section of the multicomponent filaments and extending continuously along the length of the multicomponent filaments, the second component constituting at least a portion of the peripheral surface of the multicomponent filaments continuously along the length of the multicomponent filaments; and continuous single component filaments integrated with the multicomponent filaments to form a nonwoven fabric web.

40. A nonwoven fabric as in claim 39 wherein the single component filaments include one of the polymers of the first and second components of the multicomponent filaments.

41. A nonwoven fabric as in claim 39 wherein the multicomponent filaments have natural helical crimp.

42. A nonwoven fabric as in claim 39, wherein the nonwoven fabric web is integrated by bonds formed between the multicomponent filaments and the single component filaments.

43. A nonwoven fabric as in claim 42, wherein the first component of the multicomponent filaments has a melting point and the second component of the multicomponent filaments has a melting point and the bonds between the multicomponent filaments and the single component filaments are formed by contacting web with air having a temperature below the melting point of the first component and greater than the melting point of the second component without substantially compressing the web.

44. A nonwoven fabric as in claim 42, wherein the bonds between the multicomponent filaments and single component filaments are formed by patterned application of heat and pressure.

45. A nonwoven fabric as in claim 42, wherein the bonds between the multicomponent filaments and single component filaments are formed by hydroentangling.

46. A nonwoven fabric as in claim 39, wherein the first component of the multicomponent filaments includes a polymer selected from the group consisting of polypropylene and random copolymer of propylene and ethylene and the second component of the multicomponent filaments includes polyethylene.

47. A nonwoven fabric as in claim 39, wherein the first component of the multicomponent filaments includes a polymer selected from the group consisting of polypropylene and random copolymer of propylene and ethylene and the second component of the multicomponent filaments includes a polymer selected from the group consisting of linear low density polyethylene and high density polyethylene.

48. A personal care article comprising a layer of nonwoven fabric made according to a process comprising the steps of:

a. melt spinning continuous multicomponent polymeric filaments comprising first and second polymeric components, the multicomponent filaments having a cross-section, a length, and a peripheral surface, the first and second components being arranged in substantially distinct zones across the cross-section of the multicomponent filaments and extending continuously along the length of the multicomponent filaments, the second component constituting at least a portion of the peripheral surface of the multicomponent filaments continuously along the length of the multicomponent filaments, the first and second components being selected so that the multicomponent filaments are capable of developing latent helical crimp;

b. drawing the multicomponent filaments;

c. at least partially quenching the multicomponent filaments so that the multicomponent filaments have latent helical crimp;

d. activating said latent helical crimp; and e. thereafter, forming the crimped continuous multicomponent filaments into a first nonwoven fabric web.

49. A personal care article comprising a layer of nonwoven fabric comprising a plurality of nonwoven fabric webs laminated to one another, each nonwoven web comprising continuous multicomponent polymeric filaments comprising first and second polymeric components, the multicomponent filaments having a cross-section, a length, and a peripheral surface, the first and second components being arranged in substantially distinct zones across the cross-section of the multicomponent filaments and extending continuously along the length of the multicomponent filaments, the second component constituting at least a portion of the peripheral surface of the multicomponent filaments continuously along the length of the multicomponent filaments, the plurality of webs including first and second webs, the multicomponent filaments of the first web having a first degree of helical crimp and the multicomponent filaments of the second web having a second degree of helical crimp different than the first degree of helical crimp.

50. A personal care article comprising:

a layer of nonwoven fabric comprising continuous multicomponent polymeric filaments comprising first and second polymeric components, the multicomponent filaments having a cross-section, a length, and a peripheral surface, the first and second components being arranged in substantially distinct zones across the cross-section of the multicomponent filaments and extending continuously along the length of the multicomponent filaments, the second component constituting at least a portion of the peripheral surface of the multicomponent filaments continuously along the length of the multicomponent filaments; and continuous single component filaments integrated with the multicomponent filaments to form a nonwoven fabric web.

* * * * *